US009978552B2

(12) United States Patent
Kalous et al.

(10) Patent No.: US 9,978,552 B2
(45) Date of Patent: May 22, 2018

(54) ASSEMBLY DEVICE, CIRCUIT BREAKER SYSTEM AND METHOD FOR IMPROVING FIXING A MOLDED CASE CIRCUIT BREAKER TO A BUS BAR

(71) Applicant: Siemens Aktiengesellschaft, Munich (DE)

(72) Inventors: Lukas Kalous, Vermerovice (CZ); Pavel Mrtvy, Prerov (CZ)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days. days.

(21) Appl. No.: 15/183,898

(22) Filed: Jun. 16, 2016

(65) Prior Publication Data

US 2017/0076897 A1 Mar. 16, 2017

(30) Foreign Application Priority Data

Sep. 15, 2015 (EP) ..... 15185207

(51) Int. Cl.
*H01H 1/64* (2006.01)
*H01H 1/66* (2006.01)
(Continued)

(52) U.S. Cl.
CPC ..... *H01H 71/0264* (2013.01); *H01H 71/082* (2013.01)

(58) Field of Classification Search
CPC .. H01H 71/0264; H01H 71/082; H01H 13/04; H01H 19/04; H01H 21/01; H01H 73/06; H01H 73/08; H01H 73/10; H01H 2009/02; H01H 2009/0214; H01H 2071/02; H01H 2071/0207; H01H 2071/0242; H01H 2071/0264; H01H 2223/00
(Continued)

(56) References Cited

U.S. PATENT DOCUMENTS 4,358,815 A * 11/1982 Koslosky ..... H02B 1/056 361/636
5,811,749 A 9/1998 Bausch et al.
2016/0102696 A1* 4/2016 DeClark ..... F16B 13/08 411/60.2

FOREIGN PATENT DOCUMENTS

DE 3877379 T2 7/1993
DE 102004017393 B3 12/2005
(Continued)

*Primary Examiner* — Anthony R. Jimenez
(74) *Attorney, Agent, or Firm* — Harness, Dickey & Pierce, PLC

(57) ABSTRACT

An assembly device is disclosed for fixing a molded case circuit breaker, including a housing with at least one screw hole for a fixation screw for fixing the molded case circuit breaker to a bus bar. The assembly device includes a screw head holding device for holding a screw head of the fixation screw, the assembly device being configured to be arranged inside a cavity of the housing of the molded case circuit breaker in such a way that a screw head of a fixation screw arranged at the screw hole for mounting the molded case circuit breaker to the bus bar is engageable with the screw head holding device in an engagement direction. Furthermore, a circuit breaker system is disclosed including a molded case circuit breaker and an assembly device. Moreover, a method is disclosed for mounting a molded case circuit breaker to a bus bar.

20 Claims, 2 Drawing Sheets

(51) Int. Cl.

| | |
|---|---|
| ***H01H 9/02*** | (2006.01) |
| ***H01H 9/06*** | (2006.01) |
| ***H01H 13/00*** | (2006.01) |
| ***H01H 19/04*** | (2006.01) |
| ***H01H 19/08*** | (2006.01) |
| ***H01H 21/00*** | (2006.01) |
| ***H01H 71/02*** | (2006.01) |
| ***H01H 71/08*** | (2006.01) |

(58) Field of Classification Search
USPC ..... 200/293, 296, 297, 318, 333, 345, 303;
361/1, 600, 605, 615–617, 627, 631, 641,
361/657–659, 667, 740, 741
See application file for complete search history.

(56) References Cited

FOREIGN PATENT DOCUMENTS

| | | | |
|---|---|---|---|
| EP | 0327385 | A1 | 8/1989 |
| EP | 2849201 | A1 | 3/2015 |
| EP | 2851926 | A1 | 3/2015 |

* cited by examiner

ASSEMBLY DEVICE, CIRCUIT BREAKER SYSTEM AND METHOD FOR IMPROVING FIXING A MOLDED CASE CIRCUIT BREAKER TO A BUS BAR

PRIORITY STATEMENT

The present application hereby claims priority under 35 U.S.C. § 119 to European patent application number EP15185207.6 filed Sep. 15, 2015, the entire contents of which are hereby incorporated herein by reference.

FIELD

At least one embodiment of the invention generally relates to an assembly device for improving fixing a molded case circuit breaker to a bus bar. Further, at least one embodiment of the invention generally relates to a circuit breaker system, comprising a molded case circuit breaker an assembly device, as well as to a method for mounting a molded case circuit breaker to a bus bar.

BACKGROUND

It is known that molded case circuit breakers (MCCB) are mounted into electric control cabinets by attaching the MCCB to a bus bar that is fixed within an interior of the electric control cabinet, e.g. at a back wall of the electric control cabinet. For securing the MCCB at the bus bar, often fixation screws are used, since they provide a secure fixation of the MCCB at the bus bar and are easy to remove in case the MCCB is broken and has to be replaced.

For many applications and due to cost efficiency reasons, electric control cabinet space is rare. Therefore, MCCBs with small outer dimensions and compact connection devices have been developed. For saving space, screw holes for fixation screws have been moved from a side to an inside of the MCCBs. Standard MCCBs have a plurality of screw holes, especially three, aligned side by side for fixing the MCCBs to the bus bar. However, for a fixation procedure it is hard to locate all screws at a correct place at the MCCB or keeping them in position before screwing them into the bus bar. Since the screw hole is inside the MCCB, it is hardly possible and sometimes even impossible to hold the screws with external screw holding device, such as forceps, in position. As a result, e.g. during positioning the screws at the MCCB, one or more screws can fall off the MCCB and fall into the electric control cabinet. These screws may even block subsequent assembly at the bus bar. In that case, the screw must be removed and a new screw has to be located at the MCCB. This overall procedure is quite time and cost intensive.

SUMMARY

At least one embodiment of the present invention provides a solution in an effort to avoid at least one of the above-mentioned deficiencies. At least one embodiment of the present invention provides an assembly device for improving fixing a molded case circuit breaker to a bus bar, a circuit breaker system and/or a method for mounting a molded case circuit breaker to a bus bar that allow, for example, a more efficient time reduced and cost reduced assembly of a molded case circuit breaker to a bus bar.

Embodiments of the present invention are directed to an assembly device; a circuit breaker system; and a method for mounting a molded case circuit breaker to a bus bar. Further aspects and embodiments of the present invention are addressed in the claims. Features and details discussed with respect to embodiments of the inventive assembly device therefore are also correlated with embodiments of the inventive molded case circuit breaker system and embodiments of the inventive method and the other way around.

According to a first embodiment of the invention, an assembly device is provided for improving fixing a molded case circuit breaker to a bus bar, wherein the molded case circuit breaker has a housing with at least one screw hole for a fixation screw for fixing the molded case circuit breaker to the bus bar. The assembly device includes a screw head holding device for holding a screw head of the fixation screw. Furthermore, the assembly device is configured for being arranged inside a cavity of the housing of the molded case circuit breaker in a way that a screw head of a fixation screw that is arranged at the screw hole for mounting the molded case circuit breaker to the bus bar can engage with the screw head holding device in an engagement direction.

A second embodiment of the invention includes a circuit breaker system, comprising a molded case circuit breaker with a housing, at least one cavity for receiving the assembly device and at least a screw hole for fixing the molded case circuit breaker to a bus bar with a fixation screw and an assembly device according to at least one embodiment of the invention. The housing of the molded case circuit breaker has a cavity for receiving the assembly device, preferably in a way that the assembly device is fixed, more preferred temporarily fixed, to the circuit breaker. It is preferred that in each cavity a screw hole is located.

A third embodiment of the invention includes a method for mounting a molded case circuit breaker to a bus bar. The method comprises:

- providing a molded case circuit breaker system (for example according to the second embodiment of the invention);
- putting a shaft of a fixation screw through a screw hole of a housing of the circuit breaker;
- arranging an assembly device of the circuit breaker system at the housing in a way that a screw head holding device of the assembly device is aligned with a screw head of the screw;
- moving the screw head into a reception of the screw head holding device until the screw head is releaseably fixed within the screw head holding device;
- arranging the circuit breaker at a mounting location at the bus bar; and
- fixing the fixation screw and thereby fixing the molded case circuit breaker to the bus bar.

BRIEF DESCRIPTION OF THE DRAWINGS

In the following, the assembly device, circuit breaker system and method for mounting a molded case circuit breaker to a bus bar according to embodiments of the invention are further explained by way of example embodiments. In the following, the same parts show the same reference numerals. In the drawings.

DETAILED DESCRIPTION OF THE EXAMPLE EMBODIMENTS

Figure 1:
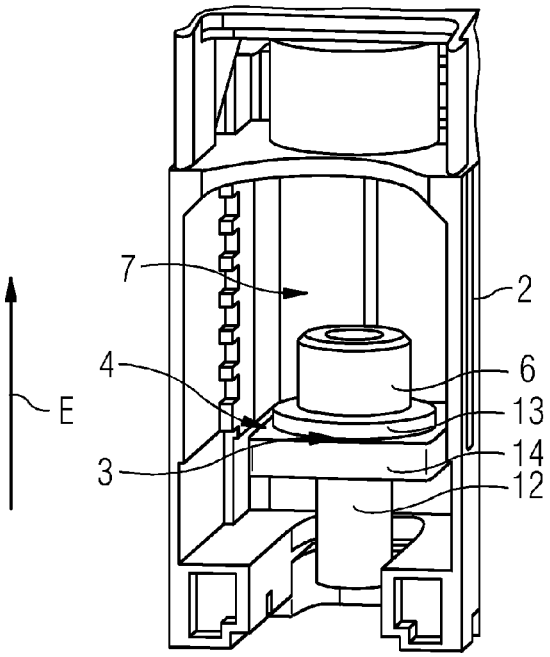
FIG. 1 schematically shows in a perspective view of a first assembly step for arranging a screw at a circuit breaker.

In the following, embodiments of the invention are described in detail with reference to the accompanying drawings. It is to be understood that the following description of the embodiments is given only for the purpose of illustration and is not to be taken in a limiting sense. It should be noted that the drawings are to be regarded as being schematic representations only, and elements in the drawings are not necessarily to scale with each other. Rather, the representation of the various elements is chosen such that their function and general purpose become apparent to a person skilled in the art.

The drawings are to be regarded as being schematic representations and elements illustrated in the drawings are not necessarily shown to scale. Rather, the various elements are represented such that their function and general purpose become apparent to a person skilled in the art. Any connection or coupling between functional blocks, devices, components, or other physical or functional units shown in the drawings or described herein may also be implemented by an indirect connection or coupling. A coupling between components may also be established over a wireless connection. Functional blocks may be implemented in hardware, firmware, software, or a combination thereof.

Various example embodiments will now be described more fully with reference to the accompanying drawings in which only some example embodiments are shown. Specific structural and functional details disclosed herein are merely representative for purposes of describing example embodiments. Example embodiments, however, may be embodied in various different forms, and should not be construed as being limited to only the illustrated embodiments. Rather, the illustrated embodiments are provided as examples so that this disclosure will be thorough and complete, and will fully convey the concepts of this disclosure to those skilled in the art. Accordingly, known processes, elements, and techniques, may not be described with respect to some example embodiments. Unless otherwise noted, like reference characters denote like elements throughout the attached drawings and written description, and thus descriptions will not be repeated. The present invention, however, may be embodied in many alternate forms and should not be construed as limited to only the example embodiments set forth herein.

It will be understood that, although the terms first, second, etc. may be used herein to describe various elements, components, regions, layers, and/or sections, these elements, components, regions, layers, and/or sections, should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items. The phrase "at least one of" has the same meaning as "and/or".

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below," "beneath," or "under," other elements or features would then be oriented "above" the other elements or features. Thus, the example terms "below" and "under" may encompass both an orientation of above and below. The device may be otherwise oriented (rotated 90 degrees or at other orientations) and the spatially relative descriptors used herein interpreted accordingly. In addition, when an element is referred to as being "between" two elements, the element may be the only element between the two elements, or one or more other intervening elements may be present.

Spatial and functional relationships between elements (for example, between modules) are described using various terms, including "connected," "engaged," "interfaced," and "coupled." Unless explicitly described as being "direct," when a relationship between first and second elements is described in the above disclosure, that relationship encompasses a direct relationship where no other intervening elements are present between the first and second elements, and also an indirect relationship where one or more intervening elements are present (either spatially or functionally) between the first and second elements. In contrast, when an element is referred to as being "directly" connected, engaged, interfaced, or coupled to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Also, the term "exemplary" is intended to refer to an example or illustration.

When an element is referred to as being "on," "connected to," "coupled to," or "adjacent to," another element, the element may be directly on, connected to, coupled to, or adjacent to, the other element, or one or more other intervening elements may be present. In contrast, when an element is referred to as being "directly on," "directly connected to," "directly coupled to," or "immediately adjacent to," another element there are no intervening elements present.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Before discussing example embodiments in more detail, it is noted that some example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Specific structural and functional details disclosed herein are merely representative for purposes of describing example embodiments of the present invention. This invention may, however, be embodied in many alternate forms and should not be construed as limited to only the embodiments set forth herein.

Although described with reference to specific examples and drawings, modifications, additions and substitutions of example embodiments may be variously made according to the description by those of ordinary skill in the art. For example, the described techniques may be performed in an order different with that of the methods described, and/or components such as the described system, architecture, devices, circuit, and the like, may be connected or combined to be different from the above-described methods, or results may be appropriately achieved by other components or equivalents.

According to a first embodiment of the invention, an assembly device is provided for improving fixing a molded case circuit breaker to a bus bar, wherein the molded case circuit breaker has a housing with at least one screw hole for a fixation screw for fixing the molded case circuit breaker to the bus bar. The assembly device includes a screw head holding device for holding a screw head of the fixation screw. Furthermore, the assembly device is configured for being arranged inside a cavity of the housing of the molded case circuit breaker in a way that a screw head of a fixation screw that is arranged at the screw hole for mounting the molded case circuit breaker to the bus bar can engage with the screw head holding device in an engagement direction.

An assembly device in terms of an embodiment of the invention is an auxiliary device with the main function to support an assembly procedure of the circuit breaker, such as a SIEMENS 3VA, 3VT or 3VL circuit breaker, to the bus bar. It is within the scope of at least one embodiment of the present invention that the assembly device is an external device that can be mounted to a circuit breaker, e.g. a standard molded case circuit breaker. Alternatively, the assembly device could be an integral part of the circuit breaker, as long as an assembly of a fixation screw to the molded case circuit breaker is not blocked by the assembly device.

The screw head holding device is configured for holding a screw head, especially by a frictional connection, e.g. by surrounding the screw head. Preferably, the screw head holding device is configured for engaging the screw head of an Allen screw that has a cylindrical shape. This has the advantage that the screw can be relatively rotated to the assembly device without impeding an engagement of the assembly device with the screw head. A screw head holding device has the advantage that a fixation screw can be held securely at the assembly device. Therefore, it is preferred that the screw head of the fixation screw can be engaged and held by the assembly device. However, in addition or alternatively to the screw head, it is within the scope of at least one embodiment of the invention, that the screw head holding device is configured for engaging and holding another part of the screw such as a shaft or a thread.

The assembly device can be mounted inside a cavity of the housing of the circuit breaker. It is preferred that, when mounted to the circuit breaker, the assembly device is fixed to the housing e.g. by frictional connection or form fit. The assembly device is further configured that, in that position, the screw head holder is aligned with a screw hole of the housing. Consequently, when a fixation screw is inserted through the screw hole, a screw head of the fixation screw is aligned with the screw head holding device. This has the advantage that the screw head of the fixation screw can be easily engaged with the screw head fixation device. Preferably, the screw hole has an inner diameter that is larger than an outer diameter of the fixation screw in order to allow easy inserting a shaft of the fixation screw into the screw hole without an engagement of the thread of the fixation screw with the screw hole.

Preferably, the assembly device, especially the screw head holding device, is a plastic part. It is also preferred that the assembly device, especially the screw head holding device, comprises flexible material. This has the advantages, that the screw head holding device can be elastically deformed due to engaging with the screw head and thereby generating a holding force against the screw head.

The assembly device has the advantage that a fixation screw can be temporarily fixed to the housing of the molded case circuit breaker easily and safely via the assembly device. Especially when more fixation screws have to be arranged at the circuit breaker, this is an advantage because without the assembly device of an embodiment of the invention, it is hardly possible to keep a plurality of fixation screws positioned at the molded case circuit breaker during the assembly procedure. With the assembly device, the plurality of screws is temporarily fixable to the housing of the circuit breaker. Consequently, unwanted falling-off of the fixation screws is hardly possible. As such, assembly time as well as costs can be reduced significantly.

In at least one embodiment, the screw head holding device is configured such that the engagement direction is parallel to a longitudinal axis of the fixation screw. This means e.g. that a center axis of the screw head holding device is coaxial or basically coaxial with a center axis, respectively longitudinal axis, of the fixation screw. This has the advantage that engaging the screw head with the screw head fixation device is improved.

In a preferred embodiment of the invention, the screw head holding device has an inner reception that is configured for receiving and holding the screw head. The reception can be configured for engaging the screw head from an outside direction, e.g. an outer surface of the screw head that is facing away from the central axis of the fixation screw, or an inside direction, e.g. a recess of a Phillips screw. A reception has the advantage that holding of the screw head, especially of an Allen screw, is improved.

Preferably, the reception has an opening for receiving the screw head and at least a stop element for preventing the screw head from being pushed through the reception in engagement direction. The screw head holding device can e.g. have a circumferential wall surrounding the reception. Alternatively, the screw head holding device comprises a plurality of fingers spaced apart from each other and surrounding the reception. Preferably, the reception can be elastically widened, e.g. fingers can be elastically bent, due to the engagement with the screw head. As such, a holding force can be generated for securing the screw head at the reception. The stop element is configured for preventing a movement of the screw head through the assembly device. The stop element is further configured for allowing access to the screw head from one side along the central axis with a tool, e.g. a screw driver, for tightening or loosening the fixation screw. A stop element has the advantage that the screw head cannot pass the screw head holder in one direction and, therefore, a holding of the fixation screw at the assembly device is improved.

It is preferred that the assembly device comprises three equally spaced screw head holding devices that are arranged in a way that the assembly device is mountable at the housing of a molded case circuit breaker with three respective, equally spaced screw holes, wherein each of the three screw head holding devices is alignable with a screw hole of the housing for receiving a screw head of a fixation screw that is extending through the screw hole. This assembly device is suitable for standard molded case circuit breaker with three screw holes. This feature has the advantage that all three fixation screws that are needed for fixing the molded case circuit breaker to the bus bar can be held in position by one assembly device. Furthermore, the fixation of the assembly device at the circuit breaker is improved due to an increase of surfaces of the assembly device and the molded case circuit breaker that are in frictional contact.

A second embodiment of the invention includes a circuit breaker system, comprising a molded case circuit breaker with a housing, at least one cavity for receiving the assembly device and at least a screw hole for fixing the molded case circuit breaker to a bus bar with a fixation screw and an assembly device according to at least one embodiment of the invention. The housing of the molded case circuit breaker has a cavity for receiving the assembly device, preferably in a way that the assembly device is fixed, more preferred temporarily fixed, to the circuit breaker. It is preferred that in each cavity a screw hole is located.

The circuit breaker system of at least one embodiment may have at least one of the same advantages over the state of the art as the assembly device according to at least one embodiment of the invention.

Preferably, the cavity of the housing of the molded case circuit breaker has the shape of a rim, wherein the assembly device is mountable within the rim in a way that the assembly device is releaseably fixed at the circuit breaker. A rim has the advantage, that the assembly device can be slid into the housing of the circuit breaker, while being guided by side walls of the rim. Thus, assembly of the assembly device to the molded case circuit breaker is improved.

A third embodiment of the invention includes a method for mounting a molded case circuit breaker to a bus bar. The method comprises:

- providing a molded case circuit breaker system (for example according to the second embodiment of the invention);
- putting a shaft of a fixation screw through a screw hole of a housing of the circuit breaker;
- arranging an assembly device of the circuit breaker system at the housing in a way that a screw head holding device of the assembly device is aligned with a screw head of the screw;
- moving the screw head into a reception of the screw head holding device until the screw head is releaseably fixed within the screw head holding device;
- arranging the circuit breaker at a mounting location at the bus bar; and
- fixing the fixation screw and thereby fixing the molded case circuit breaker to the bus bar.

Preferably, a washer is arranged at the shaft of the fixation screw between the screw head and the screw hole. In case a plurality of fixation screws has to be secured at a plurality of screw holes of the circuit breaker, a single assembly device can be arranged at the housing at each screw hole. Alternatively, an assembly device can be used that is configured for being arranged at more than one screw holes at the same time.

It can be advantageous that the assembly device remains arranged at the molded case circuit breaker after the molded case circuit breaker has been fixed to the bus bar, because when the molded case circuit breaker has to be removed, the fixation screws will engage with the assembly device again and are thereby secured from falling off. As such, it can be prevented that a fixation screw unintentionally falls into an electric control cabinet.

The method of at least one embodiment for mounting a molded case circuit breaker to a bus bar may have at least one of the same advantages over the state of the art as the assembly device according to at least one embodiment of the invention.

It is preferred that the assembly device is removed after the fixation screw is partly or fully engaged with a threaded portion of the bus bar. This has the advantage, that one assembly device can be reused for fixing further molded case circuit breaker to a bus bar.

Preferably, the screw head is moved into the reception of the screw head holder by pushing the screw in engagement direction. Preferably, the engagement direction is a direction parallel to the central axis of the screw. This has the advantage that engaging the screw head with the screw head holder can be achieved easily, e.g. by hand.

In FIG. 1, a part of a housing 2 of a molded case circuit breaker is schematically shown in a perspective view. In a cavity 7 of the housing 2, a fixation screw 4 is arranged. A shaft 12 of the fixation screw 4 is protruding through a screw hole 3 of a holding plate 14 of the housing 2. A washer 13 is sandwiched at the screw hole 12 between the holding plate 14 and a screw head 6 of the fixation screw 4. In this state, the fixation screw 4 is fully inserted in the screw hole 12.

Figure 2:
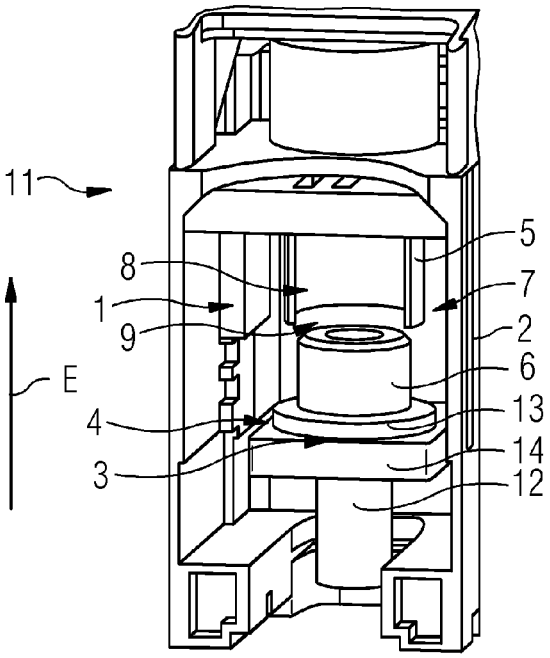
FIG. 2 schematically shows in a perspective view a second assembly step for arranging a screw at a circuit breaker.

In FIG. 2, the part of the housing 2 of the molded case circuit breaker of FIG. 1 is schematically shown in a perspective view, wherein an assembly device 1 is arranged within the cavity 7 above the screw head 6. Consequently, FIG. 2 shows a part of the circuit breaker system 11 according to the invention. The assembly device 1 comprises a screw head holding device 5 with a reception 8 for receiving and temporarily holding the screw head 6. For this purpose, the screw head 6 is insertable into the reception 8 in an engagement direction E that is parallel to a longitudinal axis of the fixation screw 4 through an opening 9. In this state, the screw head 6 is not engaged with the assembly device 1.

Figure 3:
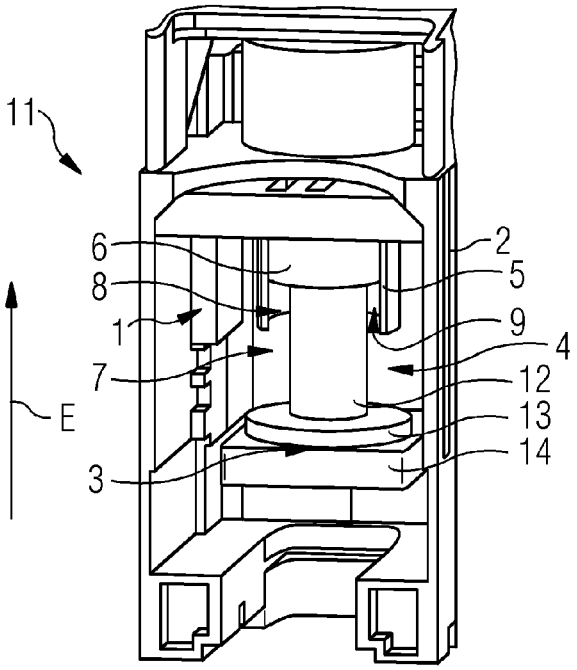
FIG. 3 schematically shows in a perspective view a third assembly step for arranging a screw at a circuit breaker.

In FIG. 3, part of the circuit breaker system 11 of FIG. 2 is shown in a perspective view, wherein the fixation screw 4 is in a different position and is not fully inserted into the screw hole 3. In this position, the screw head 6 is fully arranged inside the reception 8 of the screw head holding device 5 and thus engaged with the screw head holding device 5. The washer 13 is still secured at the shaft 12 between the holding plate 14 and the screw head 6 because a part of the shaft 12 still protrudes through the screw hole 3. In this state, the fixation screw 4 is temporarily secured at the housing 2 of the circuit breaker system 11 against falling off unintentionally.

Figure 4:
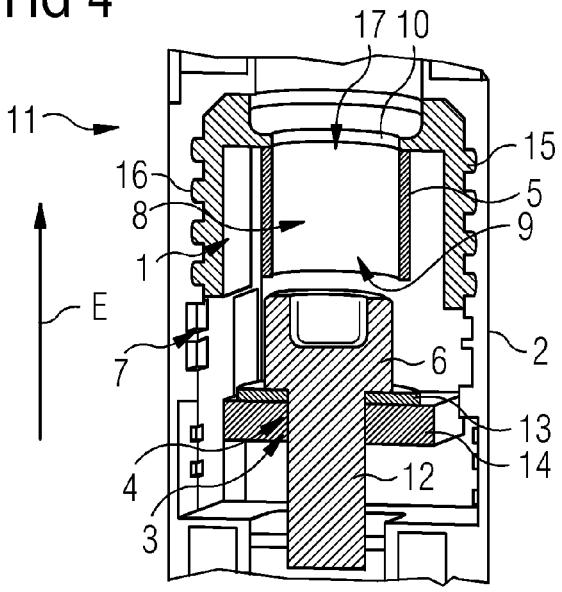
FIG. 4 schematically shows in a side view an example embodiment of a part of an example embodiment of a circuit breaker system.

FIG. 4 shows a part of an example embodiment of a circuit breaker system 11 according to an embodiment of the invention in a sectional side view. The assembly device 1 has a plurality of protrusions 15 that are inserted into respective clearances 16 of the housing 2. The protrusions 15 and clearances 16 are configured such that the assembly device 1 is linearly guided at the housing 2. Alternatively or additionally, the assembly device 1 could be secured at the housing 2 by a not shown clicking device. The assembly device 1 further comprises a stop element 10 that is arranged at a side of the reception 8 that is opposite to the opening 9. By way of the stop element 10, the screw head 6 can only be moved in and out of the reception 8 of the side of the opening 9. The stop element 10 has a central bore 17 for allowing a tool, such as a screw driver or Allen key, to engage with a respective portion of the screw head 6 in order to fasten or unfasten the fixation screw 4. In the stat shown in FIG. 4, the assembly device 1 can be removed from the housing 2. Alternatively, the screw head 6 can be moved inside the reception 8 through the opening 9 until the screw head 6 engages the stop element 10.

The patent claims of the application are formulation proposals without prejudice for obtaining more extensive patent protection. The applicant reserves the right to claim even further combinations of features previously disclosed only in the description and/or drawings.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

None of the elements recited in the claims are intended to be a means-plus-function element within the meaning of 35 U.S.C. § 112(f) unless an element is expressly recited using the phrase "means for" or, in the case of a method claim, using the phrases "operation for" or "step for."

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

REFERENCE NUMBER LIST

1 assembly device
2 housing
3 screw hole
4 fixation screw
5 screw head holding device
6 screw head
7 cavity
8 reception
9 opening
10 stop element
11 circuit breaker system
12 shaft
13 washer
14 holding plate
15 protrusion
16 clearance
17 central bore
E engagement direction

What is claimed is:

1. An assembly device for fixing a molded case circuit breaker to a bus bar, the molded case circuit breaker includes a housing with at least one screw hole for a fixation screw for fixing the molded case circuit breaker to the bus bar, the assembly device comprising:

at least one screw head holding device to hold at least opposing sides of a screw head of the fixation screw, the assembly device being configured to be arranged inside a cavity of the housing of the molded case circuit breaker such that the screw head of the fixation screw, when arranged at the screw hole for mounting the molded case circuit breaker to the bus bar, is configured to engage with the at least one screw head holding device in an engagement direction.

2. The assembly device of claim 1, wherein the at least one screw head holding device includes an inner reception, configured to receive and hold the screw head.

3. The assembly device of claim 2, wherein the reception includes an opening to receive the screw head and at least one stop element to prevent the screw head from being pushed through the reception in the engagement direction.

4. The assembly device of claim 2, wherein the at least one screw head holding device includes three equally spaced screw head holding devices, arranged in a way that the assembly device is mountable at the housing of the molded case circuit breaker with three respective, equally spaced screw holes, wherein each of the three screw head holding devices is alignable with a respective one of each of the three equally spaced screw holes of the housing to receive a respective screw head of a respective fixation screw extending through the respective one of each of the three equally spaced screw holes.

5. The assembly device of claim 3, wherein the at least one screw head holding device includes three equally spaced screw head holding devices, arranged in a way that the assembly device is mountable at the housing of the molded case circuit breaker with three respective, equally spaced screw holes, wherein each of the three screw head holding devices is alignable with a respective one of each of the three equally spaced screw holes of the housing to receive a respective screw head of a respective fixation screw extending through the respective one of each of the three equally spaced screw holes.

6. The assembly device of claim 1, wherein the at least one screw head holding device is configured such that the engagement direction is parallel to a longitudinal axis of the fixation screw.

7. The assembly device of claim 6, wherein the at least one screw head holding device includes three equally spaced screw head holding devices, arranged in a way that the assembly device is mountable at the housing of the molded case circuit breaker with three respective, equally spaced screw holes, wherein each of the three screw head holding devices is alignable with a respective one of each of the three equally spaced screw holes of the housing to receive a respective screw head of a respective fixation screw extending through the respective one of each of the three equally spaced screw holes.

8. A circuit breaker system, comprising:

the molded case circuit breaker including the housing, at least one cavity for receiving the assembly device and the at least a screw hole for fixing the molded case circuit breaker to the bus bar with the fixation screw; and the assembly device of claim 6.

9. The circuit breaker system of claim 8, wherein the cavity of the housing of the molded case circuit breaker has a shape of a rim, wherein the assembly device is mountable within the rim in such a way that the assembly device is releasably fixed at the circuit breaker.

10. The assembly device of claim 6, wherein the screw head holding device includes an inner reception, configured to receive and hold the screw head.

11. The assembly device of claim 10, wherein the reception includes an opening to receive the screw head and at least one stop element to prevent the screw head from being pushed through the reception in the engagement direction.

12. The assembly device of claim 11, wherein the at least one screw head holding device includes three equally spaced screw head holding devices, arranged in a way that the assembly device is mountable at the housing of the molded case circuit breaker with three respective, equally spaced screw holes, wherein each of the three screw head holding devices is alignable with a respective one of each of the three equally spaced screw holes of the housing to receive a respective screw head of a respective fixation screw extending through the respective one of each of the three equally spaced screw holes.

13. The assembly device of claim 1, wherein the at least one screw head holding device includes three equally spaced screw head holding devices, arranged in a way that the assembly device is mountable at the housing of the molded case circuit breaker with three respective, equally spaced screw holes, wherein each of the three screw head holding devices is alignable with a respective one of each of the three equally spaced screw holes of the housing to receive a respective screw head of a respective fixation screw extending through the respective one of each of the three equally spaced screw holes.

14. A circuit breaker system, comprising:

the assembly device of claim 13;

the molded case circuit breaker including the housing;

the screw hole for fixing the molded case circuit breaker to the bus bar with the fixation screw; and the cavity for receiving the assembly device.

15. The circuit breaker system of claim 14, wherein the cavity of the housing of the molded case circuit breaker has a shape of a rim, wherein the assembly device is mountable within the rim in such a way that the assembly device is releasably fixed at the circuit breaker.

16. A circuit breaker system, comprising:

the assembly device of claim 1;

the molded case circuit breaker including the housing;

the screw hole for fixing the molded case circuit breaker to the bus bar with the fixation screw; and the cavity for receiving the assembly device.

17. The circuit breaker system of claim 16, wherein the cavity of the housing of the molded case circuit breaker has a shape of a rim, wherein the assembly device is mountable within the rim in such a way that the assembly device is releasably fixed at the circuit breaker.

18. A method for mounting a molded case circuit breaker to a bus bar, the method comprising:

putting a shaft of a fixation screw through a screw hole of a housing of the circuit breaker;

arranging an assembly device of the circuit breaker system at the housing in such a way that a screw head holding device of the assembly device is aligned with a screw head of the screw;

moving the screw head into a reception of the screw head holding device until the screw head is releasably fixed within the screw head holding device;

arranging the molded case circuit breaker at a mounting location at the bus bar; and fixing the fixation screw, and thereby fixing the molded case circuit breaker to the bus bar.

19. The method of claim 18, wherein the assembly device is removed after the fixation screw is partly or fully engaged with a threaded portion of the bus bar.

20. The method of claim 18, wherein the screw head is moved into the reception by pushing.

* * * * *